United States Patent [19]

Vossos

[11] 4,123,234

[45] Oct. 31, 1978

[54] ALKANOL AMINE PHOSPHATE FOR IMPROVING ELECTROSTATIC PRECIPITATION OF DUST PARTICLES

[75] Inventor: Peter H. Vossos, Lisle, Ill.

[73] Assignee: Nalco Chemical Company, Oak Brook, Ill.

[21] Appl. No.: 859,419

[22] Filed: Dec. 12, 1977

[51] Int. Cl.[2] ..... B03C 3/00

[52] U.S. Cl. ..... 55/5

[58] Field of Search ..... 55/5, 10; 423/215.5, 423/243, 229; 260/944, 945, 928, 978

[56] References Cited

U.S. PATENT DOCUMENTS

| | | | |
|---|---|---|---|
| 2,381,879 | 8/1945 | Chittam | 55/5 |
| 2,730,542 | 1/1956 | Ferrari et al. | 260/978 |
| 3,284,990 | 11/1966 | Orne | 5/5 |

FOREIGN PATENT DOCUMENTS

| | | | |
|---|---|---|---|
| 452,167 | 8/1936 | United Kingdom | 55/73 |

*Primary Examiner*—Bernard Nozick

*Attorney, Agent, or Firm*—John G. Premo; Robert A. Miller; Barry W. Sufrin

[57] ABSTRACT

A method for the electrostatic precipitation of dust particles entrained in a gas stream which comprises adding predetermined amounts of an alkanol amine phosphate into the particle-laden gas stream in a location preceding the precipitation apparatus where the gas is at a temperature not greater than 650° F.

2 Claims, No Drawings

ALKANOL AMINE PHOSPHATE FOR IMPROVING ELECTROSTATIC PRECIPITATION OF DUST PARTICLES

INTRODUCTION

Description of the Prior Art

A conventional way of separating dust particles from a gas stream in which the particles are entrained is by the use of an electrostatic precipitator. This apparatus utilizes the corona discharge effect, i.e., the ionization of the particles by passing them through an ionization field established by a plurality of discharge electrode wires suspended in a parallel plane with a grounded collecting electrode plate. The ionized particles are attracted to the collector plate from which they may be removed by vibrating or rapping the plate. Examples of this type precipitator are found in Cummings' U.S. Pat. No. 3,109,720 and Pennington U.S. Pat. No. 3,030,753.

Dust particles have different characteristics depending upon their source. One characteristic is resistivity which is measured in ohm-centimeters. For example, where the source of particles is a coal-fixed boiler, there is usually a predictable relationship between the type of coal burned and the resistivity of the particles. Typically, low sulphur coal, i.e. less than 1% sulphur, produces particles having high resistivity, i.e. $10^{+13}$ ohm-centimeters resistance; coal with 3–4% sulphur produces particles having $10^{+6}$–$10^{+10}$ ohm-cm. resistance; and, poorly combustible coal produces particles having $10^{+4}$–$10^{+5}$ ohm-cm. resistance.

It has been found that most efficient separation or precipitation of the particles occurs when their resistivity is about $10^{+8}$–$10^{+10}$ ohm-centimeters. When the resistivity is higher than this, the precipitation process is encumbered because the particles tend to hold their charge; particles collected on the plate in a layer tend to remain negatively charged and particles subsequently charged in the gas stream are not attracted to the plate with a resultant loss of efficiency. Conversely, when the resistivity is lower than this, the low resistivity particles lose their change rapidly upon contact with the collector plate thereby being difficult to retain thereon; reentrainment then occurs with a resultant loss of efficiency. However, when the particles are of the preferred resistivity, a balance is achieved between the tendency to have either overcharged or undercharged particles with a resultant increase in precipitation efficiency. Thus, the problem which existed until now was to provide a means for reducing the resistivity of high-resistivity particles and increasing the resistivity of low-resistivity particles.

THE INVENTION

The electrostatic removal of high-resistivity particles entrained in a gas stream can be improved by the addition to such gas stream of pre-selected amounts of an alkanol amine phosphate at a point in the gas stream where the temperature is not greater than 650° F.

Dosage

The amount of alkanol amine phosphate that is effective in decreasing the resistivity of the dust particles may vary. Generally it is used in an amount ranging from 0.1 up to about 6 weight percent based on the weight of the particles present in the gas stream. In a preferred embodiment, the dosage ranges between 0.5–3% by weight.

A convenient method of dosing the alkanol amine phosphate is to add 45 – 1250 grams per metric ton of coal burned to form the gas. While the alkanol amine phosphate may be injected as solid particles, it is preferred to use it as an aqueous solution, particularly in the form of its alkali metal or ammonium salt.

The Alkanol Amine Phosphates

The alkanol amine phosphates used in the practice of this invention are readily prepared by reacting alkanol amines with phosphoric acid. The alkanol amines are conveniently prepared by reacting ammonia with suitable alkylene oxides such as, for example, ethylene oxide, 1,2-propylene oxide, 1,2-butylene oxide, and the like. While either the mono, di, or trialkanol amine phosphates can be used, it is preferred to use the trialkanol amines, the hydrogen atoms of which have been converted to the phosphate esters.

Certain of these materials may be rendered more soluble by converting them to their alkali metal or ammonium salt forms.

Examples of the typical alkanol amines that may be phosphated are mono, di, and triethanol amine, mono, di, and tripropanol amine, and mono, di, and tributanol amine. A preferred phosphate ester is triethanol amine which has been reacted with at least 2 moles of phosphoric acid.

A typical composition hereinafter referred to as Composition A is a 30% aqueous solution of triethanol amine triphosphate sodium salt.

Application Temperature

Most large coal-fired boilers are composed of a number of regions. These regions, starting with the combustion flame and ending with the electrostatic precipitator which, in most instances, is located prior to the exhaust gas stack, form a series of progressively cooler gas temperature zones. For purpose of simplification, these zones and their respective temperatures are set forth below in a simplified manner:

| Location | Temperature |
|---|---|
| In the flame - | 2500 – 3500° F |
| In the furnace-radiant section - | 2000 – 2500° F |
| After super heater - | 1000 – 1600° F |
| After economizer - | 500 –750° F |
| After air heater - | 250 – 350° F |
| Up the stack - | 250 –350° F |

The alkanol amine phosphate is added to the gas stream at a temperature not in excess of about 650° F. If used at higher temperatures, its effectiveness is substantially diminished.

Evaluation of the Invention

To evaluate the effectiveness of the treatment chemical as a gas treating aid to improve electrostatic precipitator performance, the following test method was used.

ASME Power Test Code 28, which is described in the December, 1972 issue of *Power Engineering* in an article by W. E. Archer, was one test method utilized for determining fly ash bulk electrical resistivity. Briefly, this test entailed:

a. placing a treated ash sample in a conductivity cell maintained at approximately 300° F. and at about 8% humidity;

b. lowering an electrode onto the surface of the ash sample;

c. applying 2 kv/cm at a constant field to the cell and measuring current through the ash sample;

d. calculating the resistivity of the ash sample by relying on the voltage and current readings;

e. applying increased voltages to the cell while observing the current through the ash sample until electric breakdown of the sample layer occurred; and f. calculating resistivity by relying on the voltage and current readings in the range of 85–95% of the breakdown voltage.

The treated ash sample was prepared by slurrying the fly ash in a small amount of water, adding the treatment chemical and heating to drive off the water.

The fly ash used in the test was obtained from a midwestern utility. Its characteristics are set forth below in Table I.

TABLE I

| | As Received | Baked Down With DI Water |
|---|---|---|
| Bulk Density (g/cm.$^3$) | 1.19 | 1.30 |
| Resistivity, Ambient (ohm-cm.) | $1.7 \times 10^{10}$ | $7.5 \times 10^{9}$ |
| Resistivity, 300° F. (ohm-cm.) | $1.2 \times 10^{12}$ | $9.3 \times 10^{12}$ |
| Resistivity, 300° F. moist (ohm-cm.) | $9.7 \times 10^{11}$ | $9.3 \times 10^{12}$ |
| Resistivity, breakdown (ohm-cm.) | $6.0 \times 10^{11}$ | $3.9 \times 10^{12}$ |
| Dielectric Strength (kv./cm.) | 15.00 | 23.30 |

When treated with 2% by weight (solids basis) of Composition A, the resistivity of the fly ash was found to be $5.7 \times 10^{8}$.

Having thus described our invention, it is claimed as follows:

1. In a method of improving the conductivity of particles entrained in a stream of particle-laden gas formed by the burning of coal, which particles are collected by an electrostatic precipitator the improvement of which comprises treating said gas containing particles prior to contact with the electrostatic precipitator at a temperature not greater than about 650° F. with a sufficient amount of resistivity-decreasing an alkanol amine phosphate.

2. The method of claim 1 where the alkanol amine phosphate is triethanol amine phosphate.

* * * * *